US009376191B1

(12) United States Patent
Jaszewski

(10) Patent No.: US 9,376,191 B1
(45) **Date of Patent: *Jun. 28, 2016**

(54) OUTBOARD MOTOR WITH LIGHTWEIGHT MIDSECTION HOUSING

(71) Applicant: Brunswick Corporation, Lake Forest, IL (US)

(72) Inventor: Wayne M. Jaszewski, Jackson, WI (US)

(73) Assignee: Brunswick Corporation, Lake Forest, IL (US)

( * ) Notice: Subject to any disclaimer, the term of this patent is extended or adjusted under 35 U.S.C. 154(b) by 170 days.

This patent is subject to a terminal disclaimer.

(21) Appl. No.: 14/317,424

(22) Filed: Jun. 27, 2014

(51) Int. Cl.

| | |
|---|---|
| ***B63H 20/32*** | (2006.01) |
| ***B63H 20/02*** | (2006.01) |
| ***B63H 20/24*** | (2006.01) |
| ***B63H 20/00*** | (2006.01) |

(52) U.S. Cl.
CPC ..... *B63H 20/02* (2013.01); *B63H 20/002* (2013.01); *B63H 20/245* (2013.01); *B63H 20/32* (2013.01); *F01N 2590/021* (2013.01)

(58) Field of Classification Search
CPC ..... B63H 20/02; B63H 20/32; B63H 20/24; B63H 20/245; F01N 2590/021; F01N 13/004
USPC ..... 440/76, 77, 78; D15/4; 123/195 P
See application file for complete search history.

(56) References Cited

U.S. PATENT DOCUMENTS

| | | | | |
|---|---|---|---|---|
| 1,073,920 | A * | 9/1913 | Miller | B63H 20/34 440/54 |
| 2,089,366 | A * | 8/1937 | Hansen | B63H 21/28 123/195 P |
| D114,597 | S * | 5/1939 | Morgan | 440/76 |
| 2,549,479 | A | 4/1951 | Kiekhaefer | |
| 2,555,548 | A | 6/1951 | Kiekhaefer | |
| 3,310,022 | A | 3/1967 | Kollman | |
| 3,967,446 | A | 7/1976 | Harralson et al. | |
| 4,507,092 | A | 3/1985 | Hall et al. | |
| 5,041,036 | A | 8/1991 | Clark et al. | |
| 6,354,893 | B1 * | 3/2002 | Sato | B63H 20/32 248/640 |
| 6,699,086 | B1 * | 3/2004 | Belter | F01P 3/202 123/196 AB |
| 6,921,307 | B2 | 7/2005 | Kashima et al. | |
| 7,896,304 | B1 | 3/2011 | Eichinger et al. | |
| 8,388,393 | B1 * | 3/2013 | Eichinger | B63H 21/32 123/195 P |

OTHER PUBLICATIONS

U.S. Appl. No. 13/688,109, filed Nov. 28, 2012.

* cited by examiner

*Primary Examiner* — Andrew Polay

(74) *Attorney, Agent, or Firm* — Andrus Intellectual Property Law, LLP

(57) ABSTRACT

An outboard motor to be coupled to a transom of a marine vessel includes a midsection housing having a front side configured to face the transom, a back side opposite the front side, a left side, and an opposite right side. An engine having an engine block is mounted directly to and supported by the midsection housing. A driveshaft is coupled in torque transmitting relation with a crankshaft of the engine, and a portion of the driveshaft is located exterior to the midsection housing. An exhaust pipe that conveys exhaust gas from an exhaust gas outlet of the engine downwardly away from the engine is also located exterior to the midsection housing. In one example, the midsection housing serves as a sump for engine oil.

20 Claims, 6 Drawing Sheets

OUTBOARD MOTOR WITH LIGHTWEIGHT MIDSECTION HOUSING

FIELD

The present disclosure relates to outboard motors for use in propelling marine vessels. More specifically, the present disclosure relates to design of a midsection area of an outboard motor, and to devices for coupling the outboard motor to a transom of a marine vessel.

BACKGROUND

U.S. Pat. No. 7,896,304 discloses a support system for an outboard motor that uses mounts which are configured and positioned to result in an elastic center point being located closely to a roll axis of the outboard motor which is generally vertical and extends through a center of gravity of the outboard motor. The mounts are positioned so that lines which are perpendicular to their respective center lines intersect at an angle which can be generally equal to 90 degrees. The mounts are positioned in non-interfering relationship with the exhaust components of the outboard motor and its oil sump.

Unpublished U.S. patent application Ser. No. 13/688,109, filed Nov. 28, 2012, discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of an outboard motor configured to be coupled to a transom of a marine vessel, the outboard motor comprising a midsection housing having a front side configured to face the transom, a back side opposite the front side, a left side, and an opposite right side. An engine having an engine block is mounted directly to and supported by the midsection housing. A driveshaft is coupled in torque transmitting relation with a crankshaft of the engine, and a portion of the driveshaft is located exterior to the midsection housing. An exhaust pipe conveys exhaust gas from an exhaust gas outlet of the engine downwardly away from the engine. The exhaust pipe is located exterior to the midsection housing.

Another example of the present disclosure is of an outboard motor configured to be coupled to a transom of a marine vessel. The outboard motor comprises an engine having an engine block having a bottom surface and midsection housing having a top surface and a bottom surface. A gearcase assembly is coupled to the bottom surface of the midsection housing. A driveshaft extends from the engine to the gearcase assembly, and a portion of the driveshaft is located exterior to the midsection housing. An exhaust pipe conveys exhaust downwardly away from the engine. The exhaust pipe is located exterior to the midsection housing. A mounting cradle is mounted directly to the midsection housing, the mounting cradle being coupled to the transom. The bottom surface of the engine block is mounted directly to the top surface of the midsection housing.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
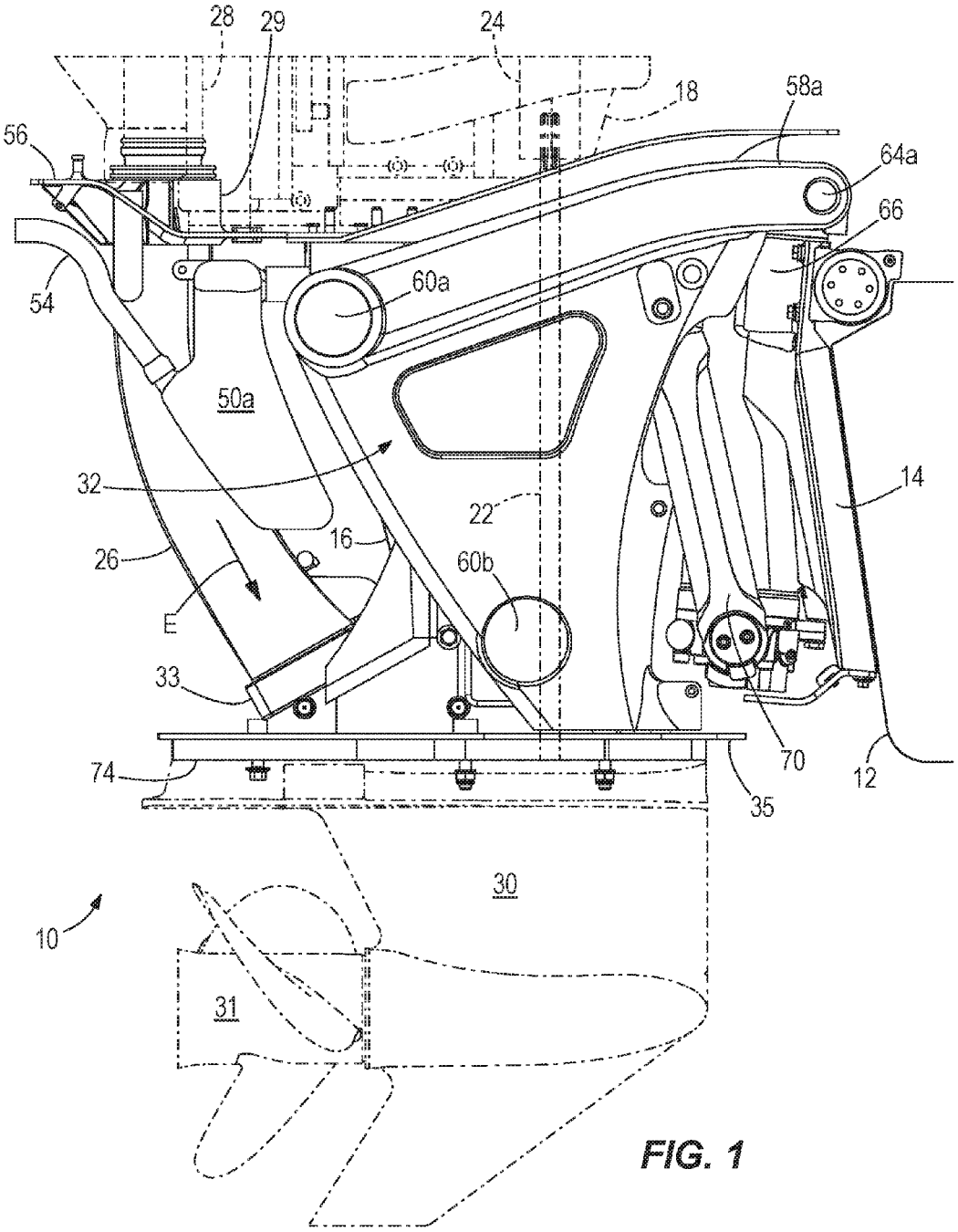
FIG. 1 illustrates a side view of a portion of an outboard motor according to the present disclosure.
Figure 2:
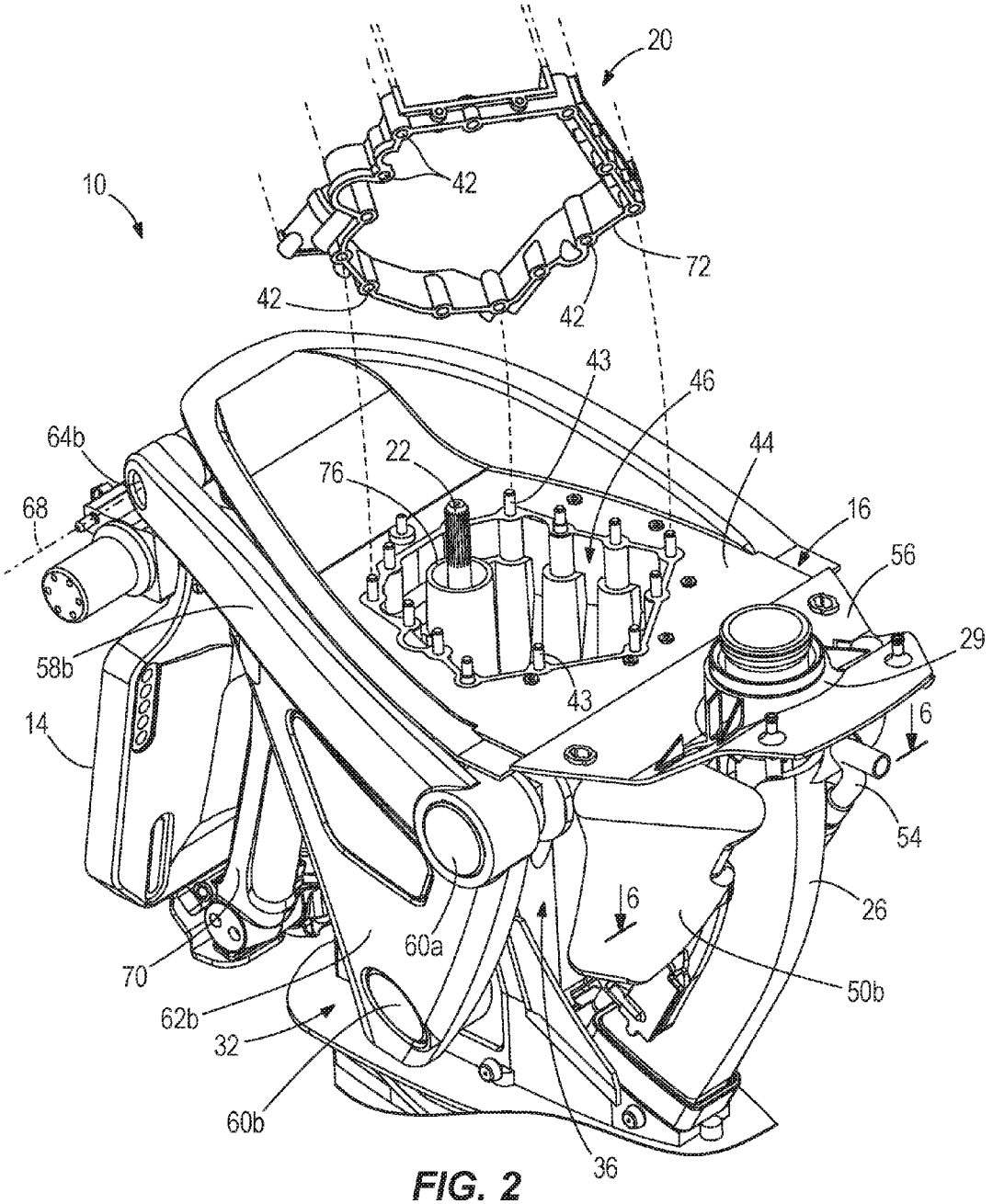
FIG. 2 illustrates a perspective view of a top surface of a midsection housing of the outboard motor of FIG. 1.

FIG. 1 illustrates a side view of a portion of an outboard motor 10 according to the present disclosure. The outboard motor 10 is configured to be coupled to a transom 12 of a marine vessel (not shown) via a transom bracket 14. The outboard motor 10 comprises a midsection housing 16 (see also FIG. 2). The outboard motor 10 further comprises an engine 18 that is supported by and coupled to the midsection housing 16. The engine 18 has an engine block 20, a bottom portion of which is shown in FIG. 2. The outboard motor 10 further comprises a driveshaft 22, shown in phantom in FIG. 1, coupled in torque transmitting relation with a crankshaft 24 of the engine 18, for example via a splined connection.

The outboard motor 10 further comprises a gearcase assembly 30 coupled to a lower portion of the midsection housing 16. An exhaust pipe 26 conveys exhaust gas from an exhaust gas outlet 28 of the engine 18 downwardly away from the engine 18, as shown by the arrow E and into the gearcase assembly 30. An upper end of the exhaust pipe 26 extends through a cylindrical fitting 29 provided in a stabilizing plate 56 to the exhaust gas outlet 28. A lower end of the exhaust pipe 26 extends through a rectangular fitting 33 in a plate 35 defining the lower portion of the midsection housing 16. When the engine 18 is running above idle speeds, a normal flow of exhaust is downwardly away from the engine 18, through the exhaust pipe 26, into the gearcase assembly 30, and out along an axis of a propeller hub 31 coupled to the gear case assembly 30. The exhaust pipe 26 is separate from and located exterior to the midsection housing 16 (see also FIG. 6)

and on a side of the midsection housing 16 that faces away from the transom 12 of the marine vessel.

Also shown in FIG. 1 is a mounting arrangement including a mounting cradle 32 that couples the midsection housing 16 to the transom 12 of the marine vessel via the transom bracket 14. A swivel bracket 66 pivotably coupled to the transom bracket 14 and a pair of tilt/trim cylinders 70 (one of which is shown in FIG. 1) are also provided in the mounting arrangement, and facilitate movement of the outboard motor with respect to the marine vessel as is known to those having ordinary skill in the art. The mounting arrangement will be described further herein below.

Figure 3:
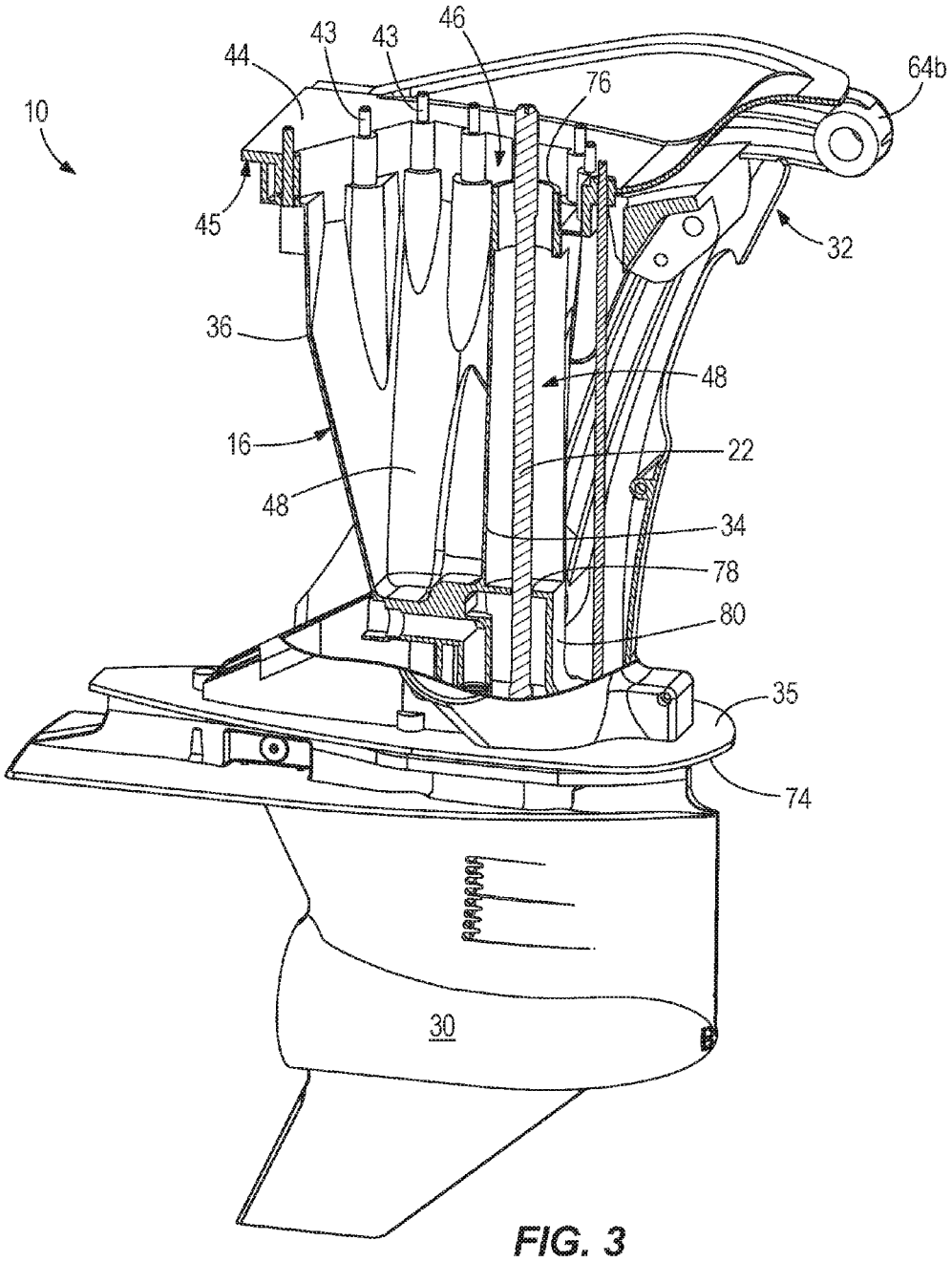
FIG. 3 illustrates a cross-sectional view of a portion of the outboard motor of FIG. 1.
Figure 4:
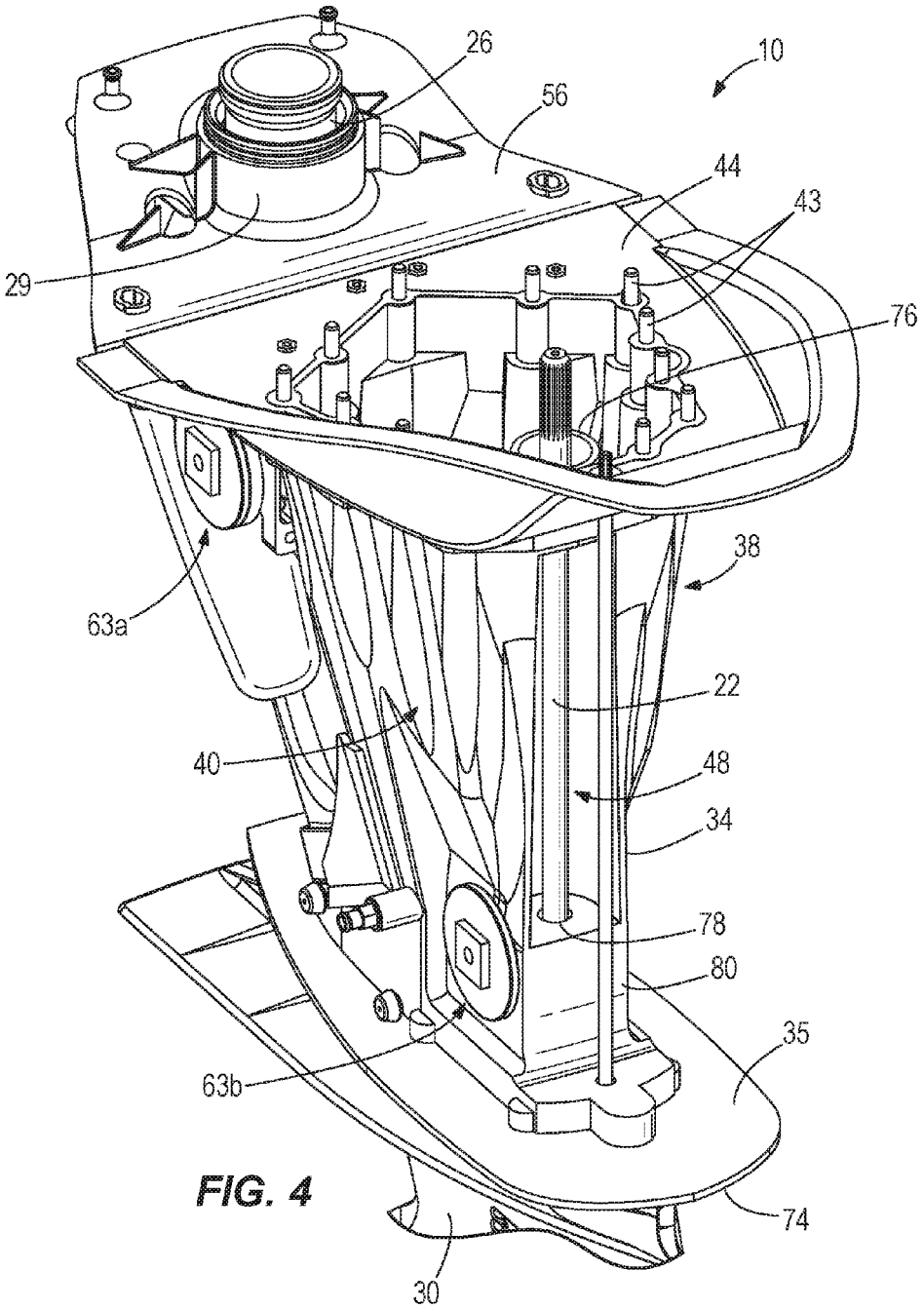
FIG. 4 illustrates a perspective top/front view of the midsection housing.

Now turning to FIGS. 2-4, various aspects of the midsection housing 16 will be described. The midsection housing 16 has a front side 34 configured to face the transom 12 of the marine vessel, and a back side 36 opposite the front side 34. The midsection housing 16 further has a left side 38 and an opposite right side 40. The left and right sides are termed such as if the midsection housing 16 is being viewed from the back side 36. It should be understood that by describing "sides" of the midsection housing 16, it is not meant that the housing 16 must have flat surfaces and/or have a generally rectangular form. Although the midsection housing 16 certainly could have a rectangular form, the midsection housing 16 shown in the example herein roughly has the shape of a pentagon. The base of the pentagon corresponds to the front side 34 of the midsection housing 16, while the angled sides opposite the base of the pentagon corresponds to the back side 36. It should be understood that the midsection housing could have a polygonal shape other than a pentagon. Additionally, the sides 34, 36, 38, 40 of the midsection housing 16 need not be flat, but could be ribbed or fluted as shown herein. With reference to FIGS. 3 and 4, the front side 34 of the midsection housing 16 may comprise an alcove 48 that extends into the interior of the midsection housing 16, and which will be described more fully herein below.

With reference specifically to FIG. 2, a bottom portion of the engine block 20 is shown above the midsection housing 16. The engine block 20 of the engine 18 is mounted directly to and supported by the midsection housing 16. A top surface 44 of the midsection housing 16 is, in the example shown, formed as a flange that extends outwardly from the top of each side 34, 36, 38, 40 of the midsection housing 16 to create a ledge 45 (see FIG. 3) for supporting the engine 18. In one example, the top surface 44 of the midsection housing 16 has an aperture 46 therethrough that allows oil that lubricates the engine 18 to drain from the engine 18 to an interior (see FIG. 3) of the midsection housing 16. The outline of the aperture 46 also illustrates the roughly pentagonal shape of the midsection housing 16 below the flange.

In one example, coupling of a bottom surface 72 of the engine block 20 to the top surface 44 of the midsection housing 16 is accomplished by providing a plurality of fasteners 43 that extend through apertures (not shown) surrounding a circumference of the aperture 46 through the top surface 44 of the midsection housing 16. Fastener apertures 42 are provided in the bottom of the engine block 20 for receiving the fasteners 43 that extend through the top surface 44 of the midsection housing 16. In one example, the plurality of fasteners 43 comprises threaded fasteners such as bolts; however, other fasteners known to those having ordinary skill in the art could be used.

It should be noted that the pentagonal (or other) shape of the aperture 46 in the top surface 44 of the midsection housing 16 corresponds to the shape of the bottom surface 72 of the engine block 20. This ensures a fluid-tight connection between the engine block 20 and the midsection housing 16, which as described above has an open interior that may serve as an oil sump for the engine 18.

With reference to each of FIGS. 1-4, the layout of the outboard motor 10 will be further described. In the example shown, the driveshaft 22 is located proximate the front side 34 of the midsection housing 16. An upper portion of the driveshaft 22 extends through a cylindrical extrusion 76 proximate the front side 34 of the midsection housing 16. Below this, the driveshaft 22 exits the extrusion 76. A middle portion of the driveshaft 22 is thereafter located exterior to the midsection housing 16. In the example shown, this middle portion of the driveshaft 22 is located in the alcove 48 provided in the front side 34 of the midsection housing 16. The alcove 48 is shown having a semi-cylindrical shape, but could take any other shape so long as it allows for unhindered rotation of the driveshaft 22 therein. Near a lower end of the driveshaft 22, the driveshaft 22 extends through a cylindrical aperture 78 located in a forwardly projecting portion 80 of the front side 34 of the midsection housing 16. From there, the lowermost end of the driveshaft 22 extends into the gearcase assembly 30, where it is coupled to a propeller shaft by means known to those having ordinary skill in the art. Both the cylindrical extrusion 76 and cylindrical aperture 78 are provided with fluid-tight seals, although such seals are not shown herein.

Meanwhile, as described above, the exhaust pipe 26 is also located exterior to the midsection housing 16 and proximate the back side 36 of the midsection housing 16. The outboard motor 10 is also provided with at least one plenum chamber 50*a*, 50*b* in fluid communication with an idle relief port in the exhaust pipe 26, for purposes of attenuating sound produced by idle relief gas, as will be further described herein below. As shown, the plenum chambers 50*a*, 50*b* are separate components from the midsection housing 16. In one example, first and second plenum chambers 50*a*, 50*b* are provided that at least partially flank the midsection housing 16 on the right side 40 and left side 38 thereof. In another example, the plenum chambers 50*a*, 50*b* wrap around a rear portion of the exhaust pipe 26, and optionally are combined into one large plenum chamber. In the example shown, the plenum chambers 50*a*, 50*b* are mounted to the exhaust pipe 26. In other examples, the plenum chambers 50*a*, 50*b* could be mounted to the midsection housing 16 or to a plate 56 that holds an upper portion of the exhaust pipe 26 in place and is in turn coupled to the midsection housing 16. In another example, the plenum chambers 50*a*, 50*b* are mounted to both the exhaust pipe 26 and the midsection housing 16.

Figure 6:
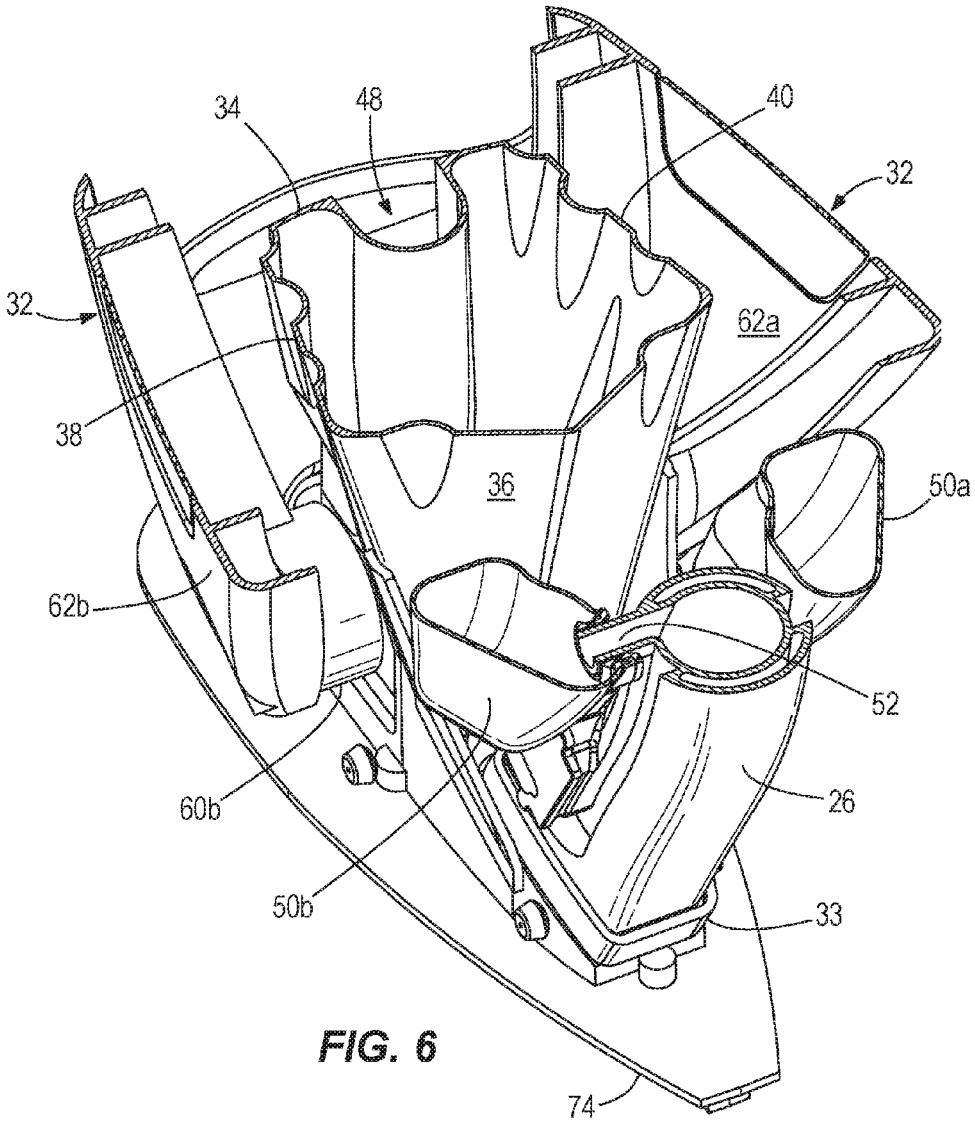
FIG. 6 illustrates a cross-sectional view taken along the line 6-6 of FIG. 2.

With reference to FIGS. 1, 2, and 6, an idle relief system for the outboard motor 10 will be further described. As described above, when the engine 18 is running and the marine vessel is underway, exhaust gas passes downwardly through the exhaust pipe 26 and out through the hub 31 of the propeller. However, when the engine 18 is idling and the marine vessel to which it is attached is moving at low speeds or is stationary, the marine vessel sits low in the water, creating a back pressure in the exhaust pipe 26 that may negatively affect performance of the engine 18. To prevent an elevated back pressure at low and idle speed conditions, the idle relief system is provided. The idle relief system comprises an idle relief port 52 in the exhaust pipe 26, the at least one plenum chamber 50*a* or 50*b*, and an idle relief outlet pipe 54 for discharging idle relief exhaust gases to an atmosphere surrounding the outboard motor 10. An outlet end of the idle relief outlet pipe 54 is located at a position that is likely not to be submerged under water when the engine 18 is idling or operating at low speeds.

When the engine 18 is idling, exhaust gases pass directly from the exhaust pipe 26 to the plenum chamber 50*a* or 50*b*. In one example, the exhaust gases pass directly from the exhaust pipe 26 to the plenum chamber 50*b* by way of the idle relief port 52 (see FIG. 6). The idle relief port 52 may comprise a short tube or pipe that provides fluid communication between an interior of the exhaust pipe 26 and an interior of the plenum chamber 50*a* or 50*b*. Because the plenum chamber 50*a* or 50*b* is a separate component from the midsection housing 16, in this way, idle relief gas does not pass through the midsection housing 16, but rather is directed through the plenum chamber 50*a* or 50*b* for purposes of sound attenuation. In the example shown, idle relief gas passes from the exhaust pipe 26, through the idle relief port 52, and into the plenum chamber 50*b*. After achieving some sound attenuation in the plenum chamber 50*b*, the idle relief gas may thereafter pass to the plenum chamber 50*a* via a port that connects the two plenum chambers 50*b*, 50*a*. Although this port is not shown, those having ordinary skill in the art would understand that a pipe or tube could be used for such a purpose. After further sound attenuation is achieved by the idle relief gas passing through the plenum chamber 50*a*, the idle relief gas exits through the idle relief outlet pipe 54 to an atmosphere surrounding the outboard motor 10.

It should be understood that although two plenum chambers 50*a*, 50*b* are shown herein, one plenum chamber could be provided in an alternative example. Further, more than two plenum chambers could instead be provided, with interconnections between the series of plenum chambers, each plenum chamber providing further sound attenuation. In one example, the plenum chambers are made of a plastic polymer, such as HDPE or polypropylene. In fact, any non-aluminum and/or non-metallic material may be used in order to both provide strength to the plenum chambers and yet reduce weight of the outboard motor 10 as a whole.

Further, it should be understood that the idle relief port 52 may comprise a short passageway as shown herein, may be a longer pipe or tube, or may be little more than a cylindrical fitting provided between the exhaust pipe 26 and the plenum chamber 50*b*. In other examples, the flow path for the idle relief gas may be through the midsection housing 16, but only briefly before or after the flow path is through the plenum chamber(s) 50*a*, 50*b*. In other words, the midsection housing 16 may be used as a conduit to carry idle relief gas to or from the plenum chamber(s) 50*a*, 50*b*, but according to the present disclosure is not used as the primary sound attenuation device itself.

Figure 5:
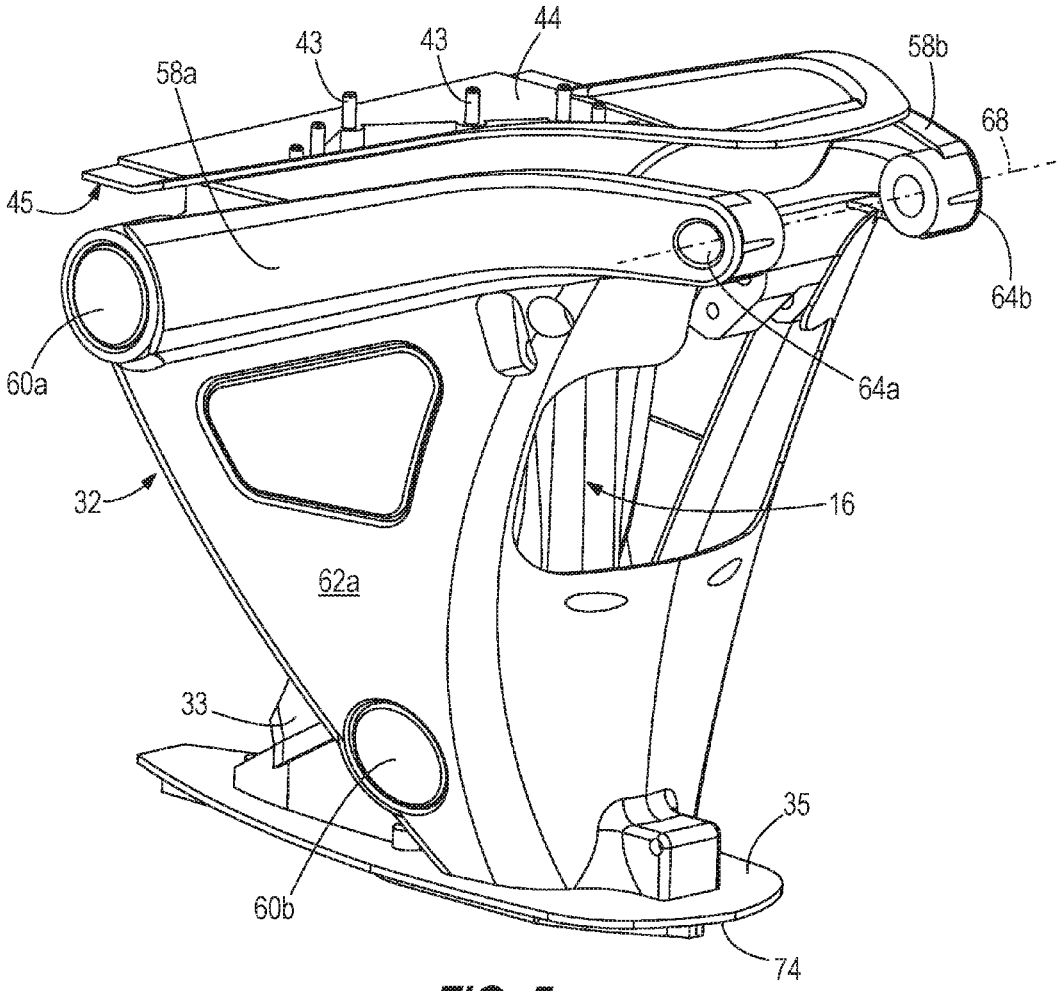
FIG. 5 illustrates a different perspective front view of the midsection housing.

With reference to FIGS. 1, 2, and 5, the system for mounting the midsection housing 16 to the transom 12 of the marine vessel will be further described. In one example, the midsection housing 16 is mounted to the transom 12 by way of a mounting cradle 32. The mounting cradle 32 sits somewhat forwardly of the plenum chambers 50*a*, 50*b* (i.e., more towards the transom 12 of the marine vessel). The mounting cradle 32 is coupled to a transom bracket 14, which is in turn mounted to the transom 12. In one example, the midsection housing 16 is mounted directly to the mounting cradle 32. For example, the mounting cradle 32 may comprise a first arm 58*b* located proximate the left side 38 of the midsection housing 16 and mounted thereto by upper and lower mounts 60*a*, 60*b*. The mounting cradle 32 may comprise a second arm 58*a* located proximate the right side 40 of the midsection housing 16 and mounted thereto by upper and lower mounts 60*a*, 60*b*. In one example, the mounts are vibration isolation mounts that damp vibration from the outboard motor 10 and to some extent prevent transmittal of this vibration to the transom 12 of the marine vessel. Other types of mounts could alternatively be used. The upper mounts 60*a* are provided in the arms 58*b*, 58*a* on the left and right sides of the outboard motor 10, respectively, and are mounted to upper portions of the midsection housing 16.

Each of the arms 58*a*, 58*b* has a somewhat triangular shaped extension 62*a*, 62*b* coupled beneath the respective arm. The lower mounts 60*b* are provided at lower corners of the triangular shaped extensions 62*a*, 62*b* and mount the extensions 62*a*, 62*b* to lower portions of the midsection housing 16 on both sides 38, 40 of the midsection housing. The location of connection of the upper mounts 60*a* is shown in FIG. 4 by arrow 63*a*. The location of connection of the lower mounts 60*b* is shown in FIG. 4 by arrow 63*b*. Although these locations 63*a*, 63*b* are shown only on right side 40 of the midsection housing 16, the mounts 60*a*, 60*b* are located at similar locations on the left side 38 of the midsection housing 16 as well.

Additional mounts 64*a*, 64*b* are provided for coupling the arms 58*a*, 58*b* to the swivel bracket 66 along the tilt/trim axis 68. As mentioned above, the outboard motor mounting system further comprises tilt/trim cylinders 70, the purpose and function of which are known to those having ordinary skill in the art.

It should be noted that the mounting cradle 32 and associated components could be constructed in many different ways with many different materials. Further, the shape of the mounting cradle 32 could vary from the example shown herein The present disclosure therefore provides a creative solution to reduce weight and cost of an outboard motor 10, in contrast to prior outboard motors that have a cast aluminum adapter plates between the engine and a cast aluminum driveshaft housing. In such prior systems, the cast aluminum driveshaft housing houses the driveshaft and also provides an interior volume for sound attenuation of idle relief gas. In contrast, in the outboard motor 10 of the present disclosure, a portion (and in this example a majority) of the driveshaft 22 is located exterior to the midsection housing 16. Further, one or more separate exterior plenum chambers 50*a*, 50*b* are provided for attenuation of sound produced by the idle relief gas instead of requiring extra volume within the driveshaft housing for such attenuation. Further, the exhaust pipe 26 of the present disclosure is provided separate from and exterior to the midsection housing 16. Each of these design components being located exterior (or at least partially exterior) to the midsection housing 16 allows the midsection housing 16 to be made much smaller, as it no longer houses the exhaust pipe, driveshaft, or provides an interior volume for sound attenuation of idle relief gas. This provides a much lighter outboard motor 10 design than previously available. Further weight reduction of the outboard motor 10 is achieved by direct mounting of the engine block 20 to the top surface 44 of the midsection housing 16. Prior designs utilize an adapter plate for such mounting, which adds weight and cost to the system. By direct mounting of the bottom surface 72 of the engine block 20 to the top surface 44 of the midsection housing 16, material and weight are both reduced. Further, because the midsection housing 16 acts as an oil sump, this eliminates the need for a separate oil sump as required by prior designs.

The present disclosure therefore provides an outboard motor 10 configured to be coupled to a transom 12 of a marine vessel. The outboard motor 10 comprises an engine 18 having an engine block 20 having a bottom surface 72 (see FIG. 2) and a midsection housing 16 having a top surface 44 and a bottom surface 74 (underside of plate 35; see FIG. 4). The bottom surface 72 of the engine block 20 is mounted directly to the top surface 44 of the midsection housing 16 with a plurality of fasteners 43. A gearcase assembly 30 is coupled to the bottom surface 74 of the midsection housing 16.

A driveshaft 22 extends from the engine 18 to the gearcase assembly 30, and a portion of the driveshaft 22 is located exterior to the midsection housing 16. For example, a middle portion of the driveshaft 22 may be provided exterior to the midsection housing 16 in an alcove 48 in the front side 34 of the midsection housing 16. An exhaust pipe 26 conveys exhaust downwardly away from the engine 18. The exhaust pipe 26 is also located exterior to the midsection housing 16 and may be provided proximate a back side 36 of the midsection housing 16. A sound-attenuating plenum chamber 50*a* or 50*b* may be provided exterior to the midsection housing 16. The plenum chamber 50*a* or 50*b* may be in direct fluid communication with an idle relief port 52 in the exhaust pipe 26.

A mounting cradle 32 is mounted directly to the midsection housing 16. For example, the mounting cradle 32 may have first and second arms 58*a*, 58*b* that extend along either side of the midsection housing 16 near a top portion thereof, and the midsection housing 16 may be mounted to the mounting cradle 32 via upper mounts 60*a* provided in the arms 58*a*, 58*b*. The mounting cradle 32 may further have two triangular shaped extensions 62*a*, 62*b*, one extension on each side of the mounting cradle 32, that extend downwardly from the arms 58*a*, 58*b*. The midsection housing 16 may be mounted to the extensions 62*a*, 62*b* via lower mounts 60*b*. The mounting cradle 32 is coupled to the transom 12. This may be done by a connection of the mounting cradle 32 to a swivel bracket 66, which is in turn coupled to a transom bracket 14, which is in turn coupled to the transom 12.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. An outboard motor configured to be coupled to a transom of a marine vessel, the outboard motor comprising:

a midsection housing having a front side configured to face the transom, a back side opposite the front side, a left side, and an opposite right side;

an engine having an engine block mounted directly to and supported by the midsection housing;

a driveshaft coupled in torque transmitting relation with a crankshaft of the engine, a portion of the driveshaft being located exterior to the midsection housing; and an exhaust pipe that conveys exhaust gas from an exhaust gas outlet of the engine downwardly away from the engine, the exhaust pipe being located exterior to the midsection housing.

2. The outboard motor of claim 1, wherein the driveshaft is located more proximate the front side of the midsection housing than the back side of the midsection housing.

3. The outboard motor of claim 2, wherein the exhaust pipe is located more proximate the back side of the midsection housing than the front side of the midsection housing.

4. The outboard motor of claim 3, further comprising a plenum chamber in fluid communication with an idle relief port in the exhaust pipe, the plenum chamber attenuating sound produced by the exhaust gas.

5. The outboard motor of claim 4, wherein the plenum chamber is a separate component from the midsection housing.

6. The outboard motor of claim 5, wherein when the engine is idling, exhaust gas passes directly from the exhaust pipe to the plenum chamber.

7. The outboard motor of claim 5, wherein the plenum chamber is made of a plastic polymer.

8. The outboard motor of claim 5, wherein the plenum chamber is mounted to the exhaust pipe.

9. The outboard motor of claim 5, further comprising first and second plenum chambers that at least partially flank the midsection housing on the right and left sides thereof.

10. The outboard motor of claim 1, further comprising a mounting cradle that couples the midsection housing to the transom.

11. The outboard motor of claim 10, wherein the midsection housing is mounted directly to the mounting cradle.

12. The outboard motor of claim 11, wherein the mounting cradle comprises a first arm located more proximate the left side than the right side of the midsection housing and mounted thereto by a first set of upper and lower mounts, and a second arm located more proximate the right side than the left side of the midsection housing and mounted thereto by a second set of upper and lower mounts.

13. The outboard motor of claim 12, wherein the first and second sets of upper and lower mounts comprise vibration isolation mounts.

14. The outboard motor of claim 1, further comprising a plurality of fasteners for mounting the engine block directly to a top surface of the midsection housing.

15. The outboard motor of claim 14, wherein the top surface of the midsection housing has an aperture therethrough that allows oil that lubricates the engine to drain from the engine to an interior of the midsection housing such that the midsection housing acts as an oil sump.

16. The outboard motor of claim 15, wherein the fasteners in the plurality of fasteners are situated around a circumference of the aperture.

17. The outboard motor of claim 14, wherein the plurality of fasteners comprises nuts and bolts.

18. The outboard motor of claim 1, wherein a majority of the driveshaft is located exterior to the midsection housing.

19. An outboard motor configured to be coupled to a transom of a marine vessel, the outboard motor comprising:

an engine having an engine block having a bottom surface;

a midsection housing having a top surface and a bottom surface;

a gearcase assembly coupled to the bottom surface of the midsection housing;

a driveshaft that extends from the engine to the gearcase assembly, a portion of the driveshaft being located exterior to the midsection housing;

an exhaust pipe that conveys exhaust downwardly away from the engine, the exhaust pipe being located exterior to the midsection housing; and a mounting cradle mounted directly to the midsection housing, the mounting cradle being coupled to the transom;

wherein the bottom surface of the engine block is mounted directly to the top surface of the midsection housing.

20. The outboard motor of claim 19, further comprising a sound-attenuating plenum chamber exterior to the midsection housing, the plenum chamber being in direct fluid communication with an idle relief port in the exhaust pipe.

* * * * *